US006851278B2

(12) United States Patent
Keenan

(10) Patent No.: US 6,851,278 B2
(45) Date of Patent: Feb. 8, 2005

(54) GEMSTONE ENCASED IN RING

(76) Inventor: Jerry Keenan, 1421 Commercial St., Astoria, OR (US) 97103

( * ) Notice: Subject to any disclaimer, the term of this patent is extended or adjusted under 35 U.S.C. 154(b) by 0 days.

(21) Appl. No.: 10/434,666

(22) Filed: May 7, 2003

(65) Prior Publication Data

US 2004/0221613 A1 Nov. 11, 2004

(51) Int. Cl.[7] ..... A44C 19/00
(52) U.S. Cl. ..... 63/15; D11/34
(58) Field of Search ..... 63/15, 26, 27, 63/28, 29.1, 34; D11/34

(56) References Cited

U.S. PATENT DOCUMENTS

| | | | | | |
|---|---|---|---|---|---|
| 1,257,848 | A | * | 2/1918 | Griffin | 63/1.15 |
| 1,428,158 | A | * | 9/1922 | Fuermann | 63/15 |
| 3,712,079 | A | * | 1/1973 | Eberle | 63/15 |
| 4,168,586 | A | * | 9/1979 | Samis | 63/15 |
| 4,989,420 | A | * | 2/1991 | Reinhold et al. | 63/15 |
| 5,218,839 | A | * | 6/1993 | Udko | 63/26 |
| D372,682 | S | * | 8/1996 | Roemer | D11/34 |
| 5,983,670 | A | * | 11/1999 | Noda | 63/26 |
| 6,450,402 | B1 | * | 9/2002 | Regev | 235/375 |
| 6,708,524 | B1 | * | 3/2004 | Masubuchi | 63/3 |
| 2002/0184916 | A1 | * | 12/2002 | Croft | 63/26 |
| 2003/0188548 | A1 | * | 10/2003 | Matano | 63/15 |

FOREIGN PATENT DOCUMENTS

| | | | | |
|---|---|---|---|---|
| DE | 3706549 C1 | * | 3/1988 | A44C/9/00 |
| DE | 4339603 A1 | * | 7/1994 | A44C/17/02 |

* cited by examiner

*Primary Examiner*—Robert J. Sandy
*Assistant Examiner*—Joan M. Olszewski
(74) *Attorney, Agent, or Firm*—Davis Wright Tremaine LLP

(57) ABSTRACT

The invention is a jewelry ring having a small gemstone embedded in the ring shank. The gemstone is embedded by making a small bore in the shank, inserting the gemstone, and covering the top of the gemstone with the same metal that is used to make the ring shank. After laser welding and polishing, the gemstone is invisible until the metal covering the stone eventually wears away.

2 Claims, 4 Drawing Sheets

GEMSTONE ENCASED IN RING

TECHNICAL FIELD

The present invention relates to jewelry. More particularly, it relates to wedding or engagement rings having gemstones.

BACKGROUND INFORMATION

Diamond engagement rings are, of course, well-known. Probably one of the most common engagement rings is the "solitaire" ring having a single stone setting. Diamonds and other gemstones have long been used in connection with jewelry of this type. The present invention is a unique type of jewelry design that, to this inventor's knowledge, has never been done in the jewelry field.

SUMMARY OF THE INVENTION

The invention is an item of jewelry, and more particularly, a unique design for a ring. In accordance with my design, the ring has a shank, as is common in typical rings, which surrounds the wearer's finger. The shank is designed to have sufficient width and thickness such that a small gemstone can be embedded in, or within, the body of the shank. The gemstone is embedded in a way so that an exterior surface of the gemstone lies immediately underneath the exterior surface of the shank and is invisible from view when the ring is new. In other words, the gemstone is covered by a thin layer of metal (e.g., gold) and the shank looks like a solid band from the outside. As the ring is worm for a period of time, the thin layer of metal covering the gemstone eventually wears and exposes it. This has significant appeal in the wedding or engagement ring markets because it suggests that relationships become stronger and more fulfilling as the years progress.

The invention as summarized above will become more completely understood upon consideration of the attached drawings and accompanying description.

BRIEF DESCRIPTION OF THE DRAWINGS

In the drawings, like reference numbers and letters refer to like parts throughout the various views, and wherein.

BEST MODE FOR CARRYING OUT THE INVENTION

Figure 1:
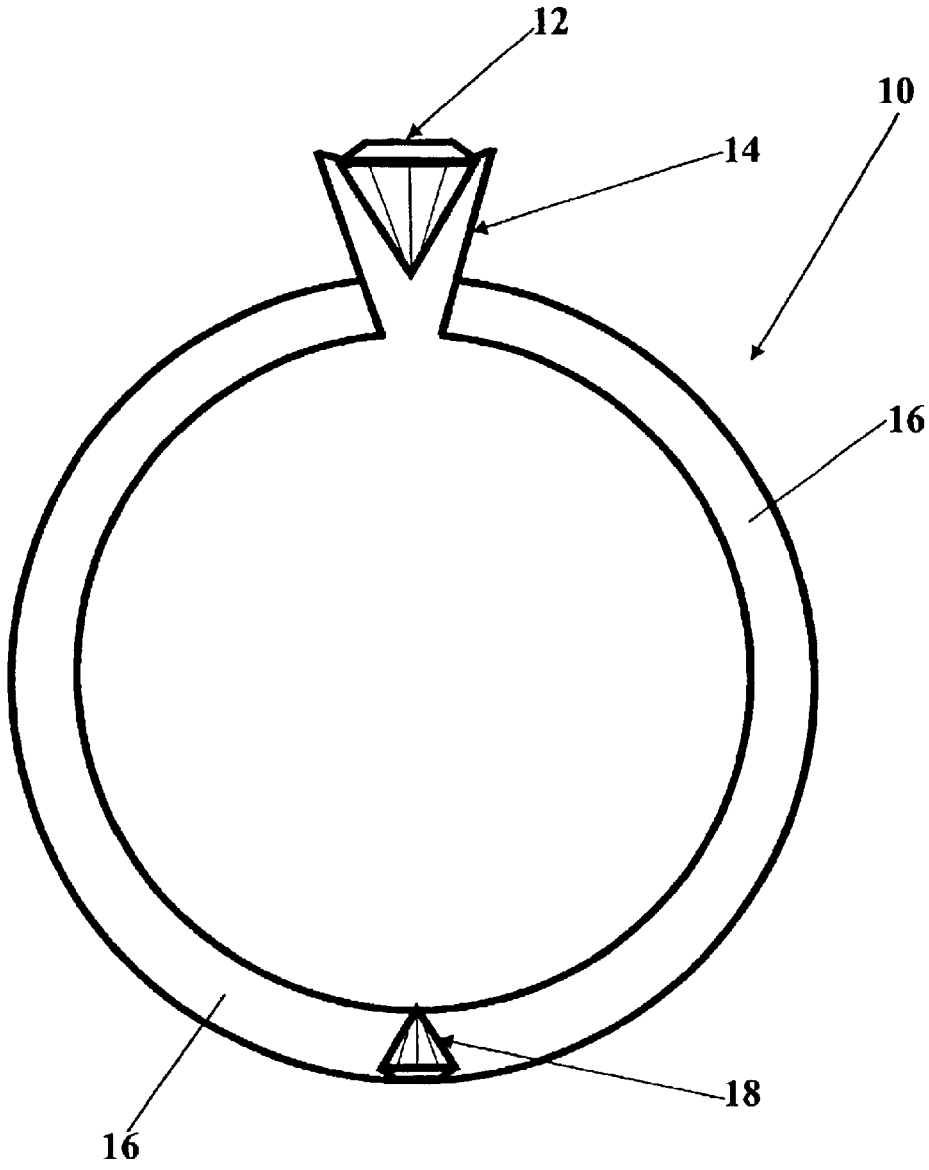
FIG. 1 is a pictorial view of a "solitaire" diamond engagement ring and illustrates a preferred embodiment of the invention.

Referring now to the drawings, and first to FIG. 1, shown generally at 10 is a diamond engagement ring. The ring 10 is conventional in construction and includes a solitaire diamond 12 (or a round brilliant diamond) held in a crown 14. Also, embedded within the ring 10 is a small-sized round brilliant diamond 18.

Figure 2:
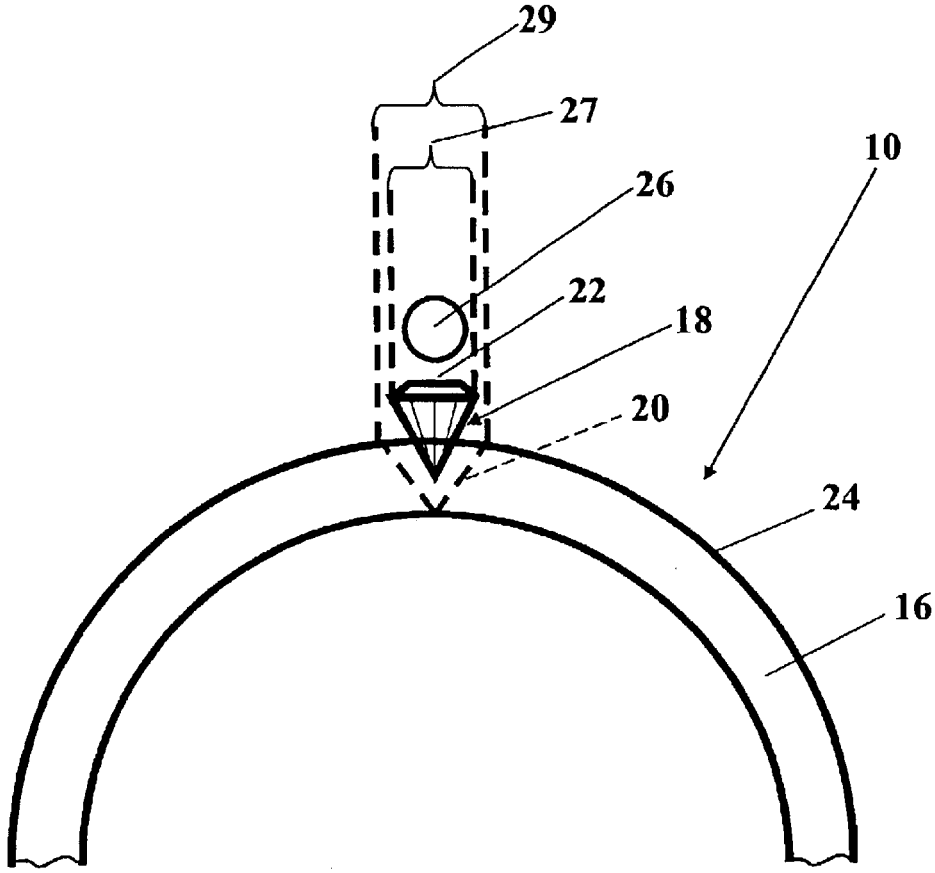
FIG. 2 is an enlarged fragmentary view of the diamond ring shown in FIG. 1.

While it is not clear in FIG. 1, FIG. 2 illustrates how the small diamond 18 is fully embedded in the shank 16 so as to be invisible to the outside. While the diameter or thickness of the shank can vary from one ring to the next, it will typically have minimum dimensions in the neighborhood of 2.25 mm in thickness and 3 mm wide. A conical bore 20 is made in the shank 12 with a jeweler's drill. After the bore

Figure 3:
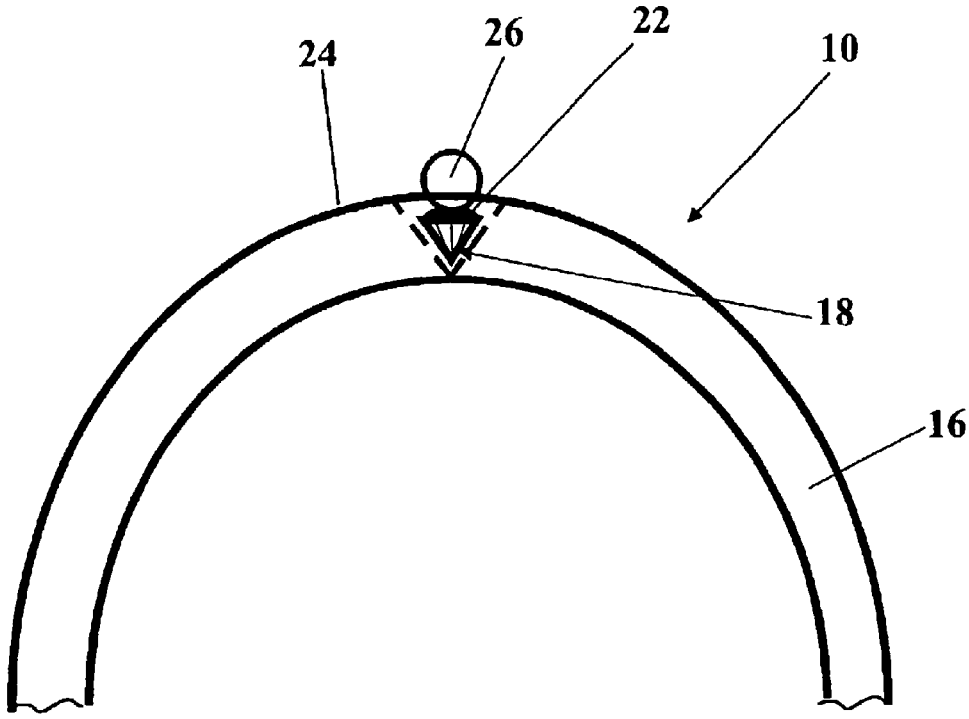
FIG. 3 is a view similar to FIG. 2.

20 is drilled, the diamond 18 is inserted into the bore as shown in FIG. 3. The bore 20 should be deep enough so that the table 22 (i.e., the very top part of the diamond) will lie below the normal contour of the shank's exterior surface 24. A small gold ball 26 is placed over the diamond 18 and hammered down over the diamond and into the bore 20. The gold ball is flattened during the hammering process so that it approximates the normal ring contour of the shank's outer surface. The flattened ball 26 is then laser welded into place and the exterior of the shank 16 is polished so that the shank exterior looks like a normal ring. A person skilled in the art would be familiar with this procedure.

While dimensions can vary, as an example, the girdle width of the diamond 18, indicated by bracket 27 in FIG. 2, may be on the order of 1.8 mm. The width of the conical bore 20, indicated by bracket 29, may be on the order of 2.0 mm, at the top. After the gold ball 26 is welded into place (and polished), there will be a small amount, or layer, of gold covering the top of diamond table 22. When the ring is purchased, it will appear to be a normal ring, and it will not be apparent to the purchaser or wearer that there is a small diamond embedded in the shank. After the ring is worn for a period of time, the gold covering the diamond will eventually wear away and the diamond will become exposed.

Figure 4:
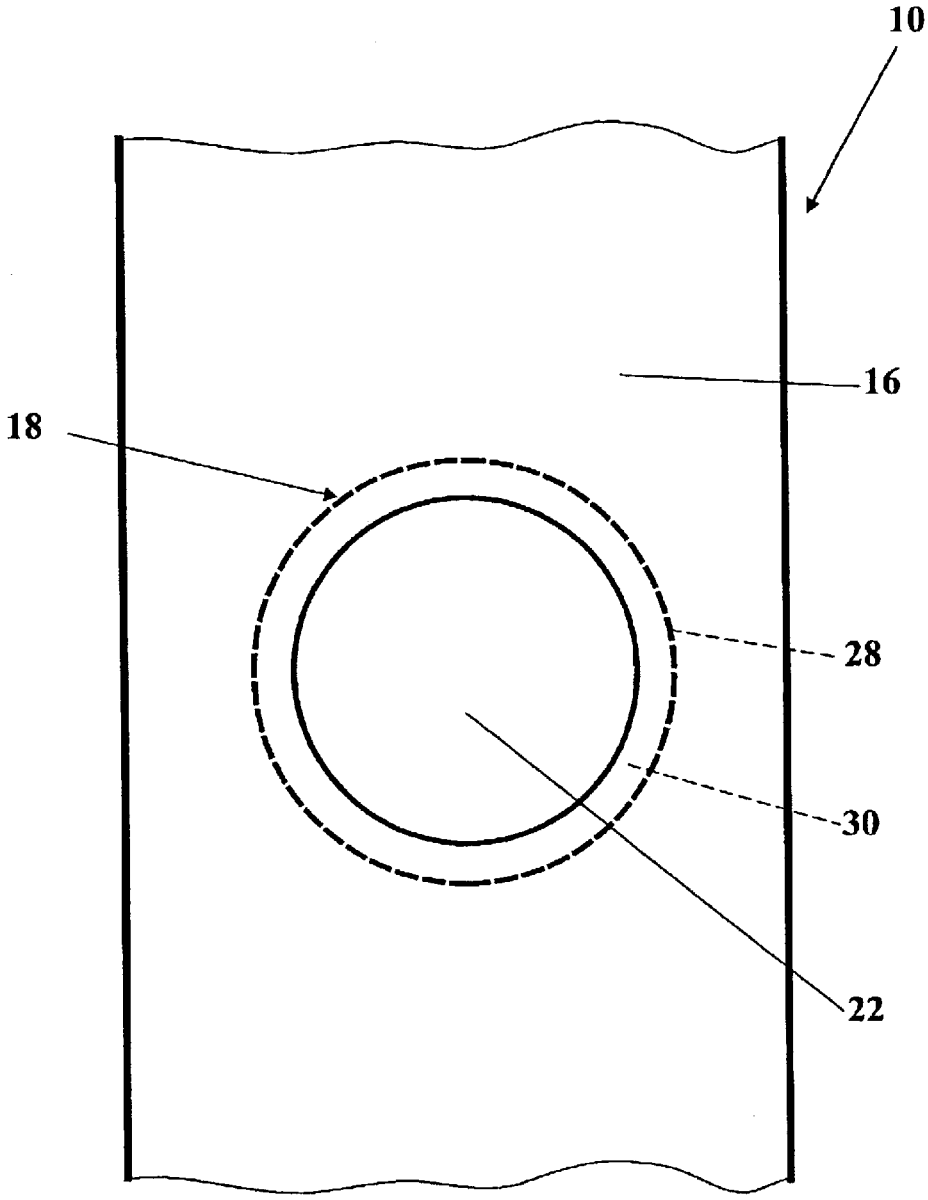
FIG. 4 is a top plan view of the shank shown in FIGS. 2–3.

Referring to FIG. 4, the girdle width of the diamond 18, after being embedded in the shank, is shown by the dashed lines 28. The crown angle (sometimes just called "the crown") from the girdle width to the table 22 is indicated in the region 30. As the gold covering the table 22 wears, the entire table surface 22 of the diamond eventually becomes exposed, as shown in FIG. 4. However, the gold will continue to cover and fill-in region 30, and thereby hold the diamond 18 in place within the shank.

It is to be appreciated that the jewelry design described above can be changed in many ways without departing from what is considered to be the spirit and scope of the invention. There may be other ways of covering the diamond in the ring besides the laser welding technique described above. It is presently believed that the laser welding/polishing technique described above is the best way. Colored diamonds or other gemstones could be used in the same way, although the size and shape of the bore 20 would have to vary in order to accommodate the specific type of stone used. Any number of diamonds could be embedded in a ring shank. Twelve might be a typical number, as an example, but the number could vary according to taste or matters relating to style. Obviously, different types of metal could be used to make the ring's shank, although it is anticipated that the ring shank will be made from gold, as is typical in engagement and diamond rings. Finally, the invention could be used in virtually any type of ring, and is not necessarily limited to the type of solitaire ring illustrated in the drawings.

The invention, therefore, is to be limited only in accordance with the subjoined patent claims which follow, the interpretation of which is to be made in accordance with the well-established doctrines of patent claim interpretation.

What is claimed is:

1. A ring, comprising:

a shank having at least one gemstone embedded within the body of the shank, with the entire gemstone being located underneath the exterior surface of the shank and hidden from view, in a manner so that the gemstone becomes exposed as the shank wears.

2. The ring of claim 1, wherein the shank is made of a precious metal, and wherein the gemstone is a diamond.

* * * * *